US006807750B1

(12) United States Patent
Lewis et al.

(10) Patent No.: US 6,807,750 B1
(45) Date of Patent: Oct. 26, 2004

(54) APPARATUS FOR AND METHOD OF CONTROLLING SEED COTTON DRYING IN A COTTON GIN

(75) Inventors: Gene C. Lewis, Memphis, TN (US); Steven E. Lewis, Lakeland, TN (US); Jerry B. Wright, Jr., Memphis, TN (US)

(73) Assignee: Cotton Moisture, LLC, Memphis, TN (US)

( * ) Notice: Subject to any disclaimer, the term of this patent is extended or adjusted under 35 U.S.C. 154(b) by 0 days.

(21) Appl. No.: 10/772,660

(22) Filed: Feb. 5, 2004

(51) Int. Cl.[7] ..... F26B 7/00

(52) U.S. Cl. ..... 34/381; 34/471; 34/476; 34/491; 34/495; 34/528; 34/531; 34/548; 34/550; 19/66 CC

(58) Field of Search ..... 34/380, 381, 471, 34/474, 475, 476, 491, 495, 497, 524, 528, 531, 548, 550, 576; 19/66 CC, 66 R

(56) References Cited

U.S. PATENT DOCUMENTS 5,189,812 A * 3/1993 Ediger ..... 34/565
5,570,521 A * 11/1996 Baker et al. ..... 34/550
5,604,996 A * 2/1997 Bestwick et al. ..... 34/484
5,992,049 A * 11/1999 Trost ..... 34/528
6,124,584 A * 9/2000 Blaker et al. ..... 219/779
6,237,195 B1 * 5/2001 Shoemaker ..... 19/66 CC
6,322,845 B1 * 11/2001 Dunlow ..... 426/629
6,389,647 B1 * 5/2002 Lewis et al. ..... 19/66 CC

FOREIGN PATENT DOCUMENTS

JP 61-187643 * 8/1986 ..... G01N/27/04

* cited by examiner

*Primary Examiner*—Stephen Gravini
(74) *Attorney, Agent, or Firm*—Walker, McKenzie & Walker, PC

(57) ABSTRACT

An apparatus and method for controlling the removal of moisture from seed cotton in a cotton gin. The moisture level and rate of seed cotton entering a seed cotton dryer stage of a cotton gin are measured, and, based on those measurements and the desired moisture level of the seed cotton, the seed cotton dryer stage of the cotton gin is controlled to remove a precise amount of moisture from the seed cotton.

6 Claims, 12 Drawing Sheets

11
27
SEED COTTON FEEDER
19
21
15
SEED COTTON DRYER STAGE
47
13
17
GIN SETS
41
45
63
59
51
53
DESIRED MOISTURE LEVEL
25
PLC
57

15
35
HOT AIR STREAM
31
36
V
33
23
M
37
GAS SUPPLY
29
63
59

APPARATUS FOR AND METHOD OF CONTROLLING SEED COTTON DRYING IN A COTTON GIN

BACKGROUND OF THE INVENTION

1. Field of the Invention

The present invention relates, in general, to the initial drying of seed cotton in a cotton gin, and in particular, to an apparatus for and a method of controlling the initial drying of seed cotton in a cotton gin.

2. Background Art

A modern cotton gin includes several coacting subsystems or stages. Seed cotton (i.e., raw cotton from the cotton field) usually arrives at the cotton gin loosely packed in large trailers or tightly compressed in large modules. The seed cotton is delivered to some type of seed cotton feeder that might include a module feeder to break-up and disperse tightly packed cotton module into a loose conveyable form, and/or a conveyor means such as a screw, belt or suction pipe to convey the loose conveyable seed cotton to initial stage of the ginning process, typically a seed cotton initial dryer stage using heated air to reduce the moisture content of the seed cotton. Such a seed cotton initial dryer stage normally include gas or oil-fired heaters for heating the air used to convey the seed cotton from the seed cotton feeder, to reduce the moisture content of the seed cotton to some desired moisture level for efficient cleaning and ginning (this moisture level is normally set by the gin management). After the seed cotton dryer stage, the seed cotton commonly passes through a rough cleaning stage to remove leaves, small trash, sticks, etc., therefrom. The partially processed seed cotton is then transferred to one or more gin stands for "ginning," i.e., for separation of the cotton seed and fiber. A typical cotton gin may have three or more gin stands. After ginning, the cotton fiber is typically referred to as "lint cotton" or just "lint." The lint may then pass through a lint cleaning stage to remove any small trash or dirt remaining in the lint, and then be carried through a lint flue or the like to a battery condenser for being formed into a continuous batt and discharged onto a lint slide. The batt is conveyed down the lint slide to a bale press where the batt is compressed and formed into one or more cotton bales. Each bale may then be tied with bailing wire and wrapped with plastic, etc., before being stored or transferred to a warehouse, textile mill, etc.

Nothing in the known prior art, either singly or in combination, discloses or suggests the present invention.

BRIEF SUMMARY OF THE INVENTION

The present invention includes an apparatus for and a method of controlling the initial seed cotton dryer stage of seed cotton in a cotton gin. The concept of the present invention is to precisely control the drying of seed cotton in the initial seed cotton dryer stage of a cotton gin in order to provide high quality ginned cotton at a lower cost by removing only the precise amount of moisture from the seed cotton to arrive at the desired moisture content of the seed cotton. The basic concept is to determine the amount of energy needed to remove a certain amount (pounds) of water from seed cotton entering a cotton gin.

The apparatus of the present invention includes means for measuring the rate of seed cotton entering a seed cotton dryer stage; means for measuring the moisture content of the seed cotton entering the seed cotton dryer stage; and means for causing the seed cotton dryer stage to remove an amount of moisture from the seed cotton based on the desired moisture content of the seed cotton after leaving the seed cotton dryer stage, the moisture content of the seed cotton entering the seed cotton dryer stage, and the rate of seed cotton entering the seed cotton dryer stage.

The method of the present invention includes the steps of measuring the rate of seed cotton entering a seed cotton dryer stage; measuring the moisture content of the seed cotton entering the seed cotton dryer stage; and controlling the seed cotton dryer stage to cause the seed cotton dryer stage to remove an amount of moisture from the seed cotton based on the desired moisture content of the seed cotton leaving the seed cotton dryer stage, the moisture content of the seed cotton entering the seed cotton dryer stage, and the rate of seed cotton entering the seed cotton dryer stage.

One object of the present invention is to provide an accurate apparatus and method for removing a precise amount of moisture from seed cotton in the seed cotton drying stage of a cotton gin.

Another object of the present invention is to provide such an apparatus and method that reduces the energy used to remove moisture from seed cotton in the seed cotton drying stage of a cotton gin to a minimum.

BRIEF DESCRIPTION OF THE SEVERAL VIEWS OF THE DRAWINGS

FIGS. 4A–4I, taken together and arranged as shown in FIG. 4, disclose a preferred program for controlling the programmable logic controller of the apparatus of the present invention based on, for example, a three gin stand system.

DETAILED DESCRIPTION OF THE INVENTION

Figures 1, 2:
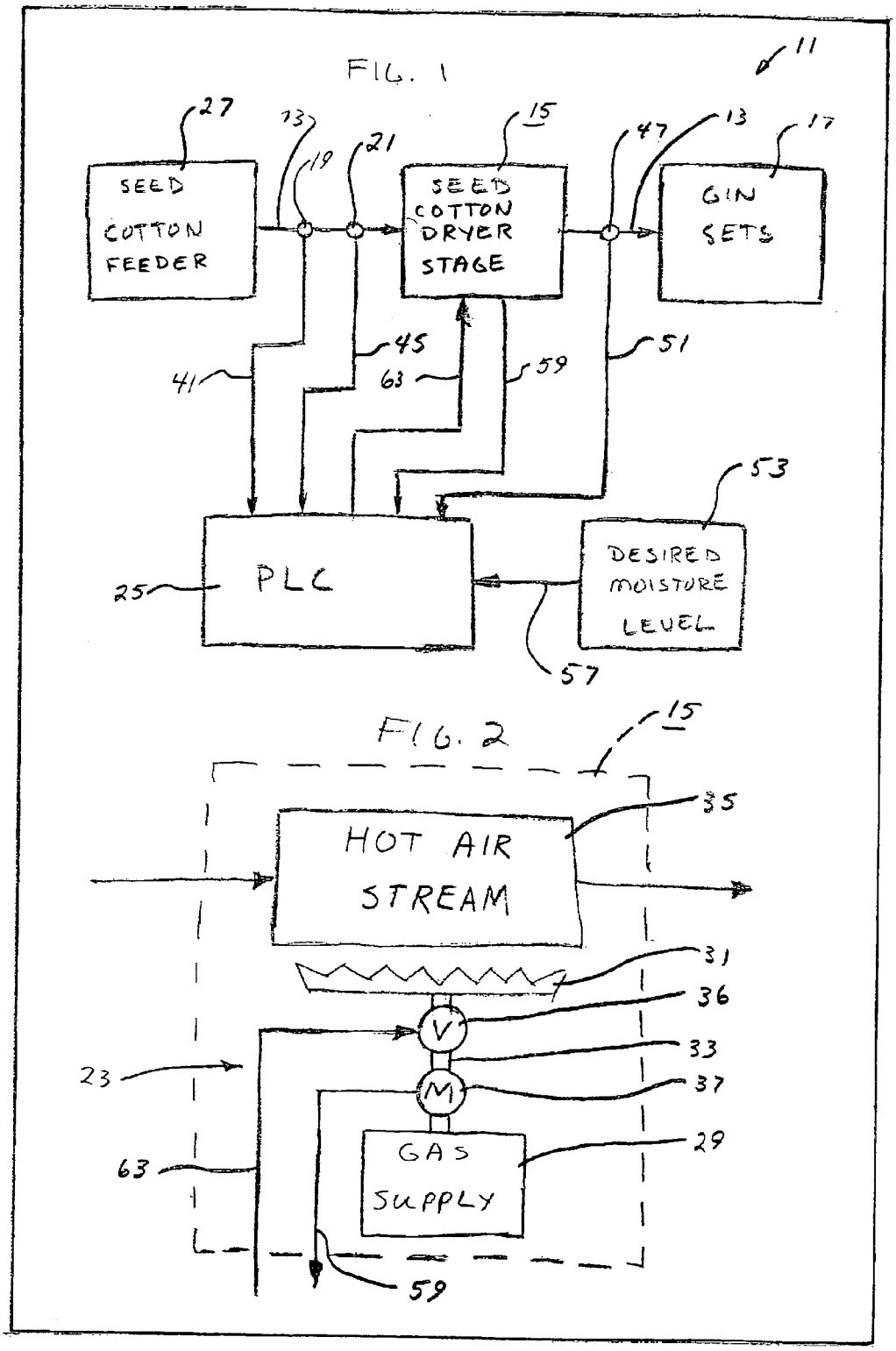
FIG. 1 is a block diagram of the apparatus of the present invention, shown in combination with various components of a cotton gin.
FIG. 2 is a more detailed diagram of portions of FIG. 1.

A preferred embodiment of the apparatus of the present invention is shown in the drawings and identified by the numeral 11. The apparatus 11 of the present invention is designed to control the removal of moisture from seed cotton, as indicated diagrammatically by arrows 13 in FIGS. 1 and 3, passing through a seed cotton dryer stage 15 to one or more gin sets or stands 17 in a typical cotton gin.

The apparatus 11 includes rate measuring means 19 for measuring the rate of seed cotton 13 entering the seed cotton dryer stage 15; moisture content measuring means 21 for measuring the moisture content of the seed cotton 13 entering the seed cotton dryer stage 15; and seed cotton dryer control means 23 for controlling the seed cotton dryer stage 15 in a manner to remove a precise amount of moisture from the seed cotton 13 based on the desired moisture content of the seed cotton 13 leaving the seed cotton dryer stage 15, the moisture content of the seed cotton 13 entering the seed cotton dryer stage 15, and the rate of seed cotton 13 entering the seed cotton dryer stage 15. The apparatus 11 preferably includes a programmable logic controller (PLC) 25 for monitoring and controlling the means 19, 21, 23, etc.

The actual construction and operation of the cotton gin may vary as will be apparent to those skilled in the art. Thus, for example, the cotton gin typically includes some type of seed cotton unloading system or feeder 27, such as a large suction pipe or module feed system, for unloading and breaking up seed cotton 13 (i.e., raw cotton from the cotton field) that usually arrives at the cotton gin in large trailers or modules, and conveying the seed cotton 13 from the trailers or modules to subsequent stages of the ginning process. The gin typically uses an air stream generated by an air fan 28 for conveying the seed cotton 13 from the seed cotton feeder 27 to some type of rough cleaning stage (i.e., a so-called stick machine 39) to remove leaves, small trash, sticks, etc. The partially processed seed cotton 13 is then transferred via a slide 40 or the like to one or more gin stands for "ginning", i.e., for separating the cotton fiber or lint from the cotton seed. Each gin stand may include a roller gin or saw gin, etc. A typical cotton gin may have three or more gin stands. After ginning, the cotton fiber is typically referred to as "lint cotton" (sometimes referred to as "cotton lint" or just "lint"). The ginned lint may then pass through a lint cleaning stage to remove additional small trash or dirt remaining in the lint. The cleaned lint is then carried through a lint flue or the like to a battery condenser, where the cleaned lint is formed into a continuous batt and discharged onto a lint slide. The batt is conveyed down the lint slide to a bale press where the batt is compressed and formed into one or more bales. Each bale may then be tied with bailing wire and wrapped with plastic, etc., before being stored or transferred to a warehouse, textile mill, etc.

Figure 3:
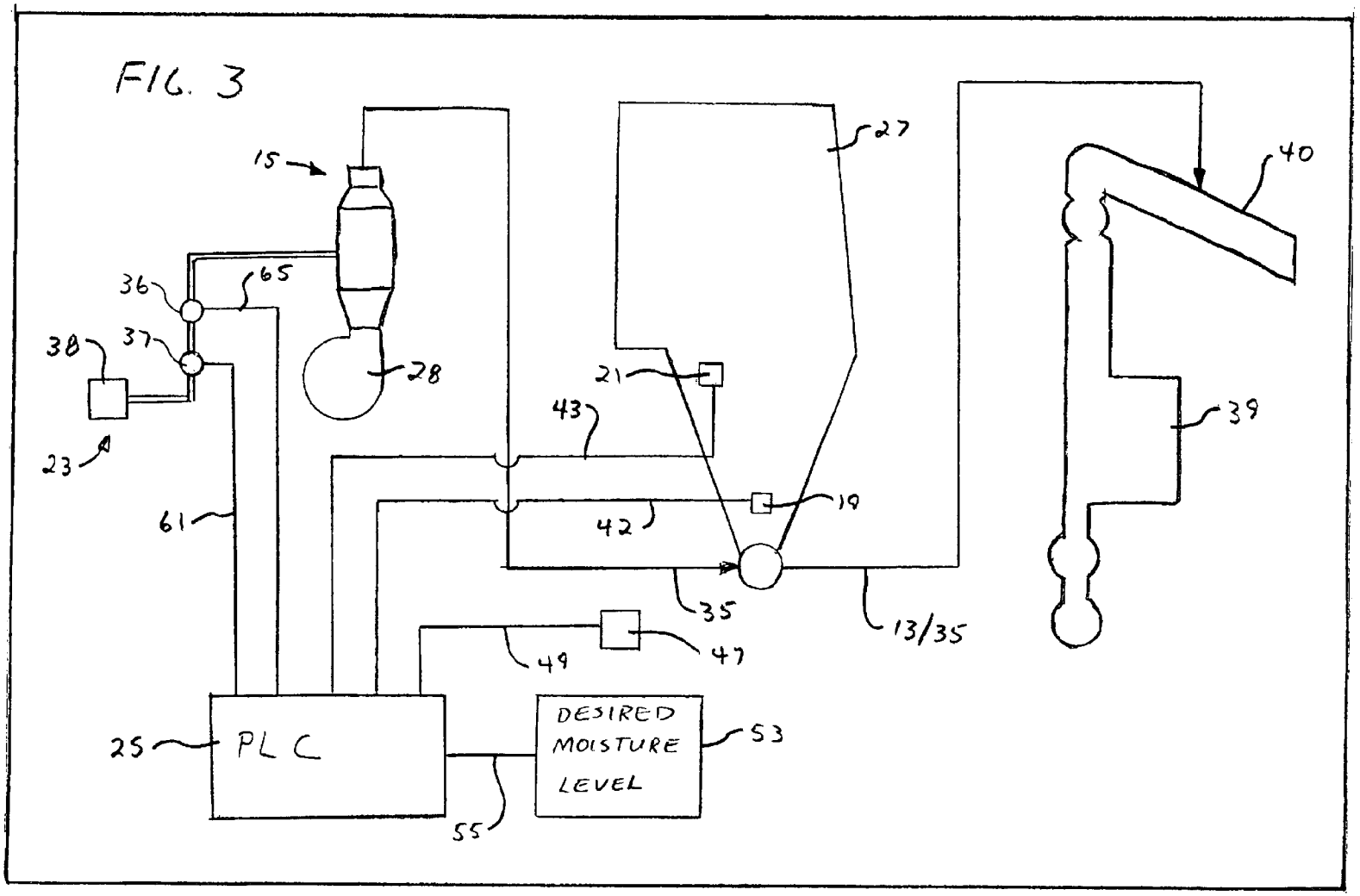
FIG. 3 is a somewhat schematic view of the apparatus of the present invention, shown in combination with various portions of a cotton gin.

The seed cotton dryer stage 15 is commonly created by heating the air stream generated by the air fan 28 to form a hot air stream to remove moisture from the seed cotton 13 as the seed cotton 13 is conveyed from the seed cotton feeder 27. The seed cotton dryer stage 15 may include a gas or oil-fired heater for heating the air to reduce the moisture content of the seed cotton 13. For example, as diagrammatically shown in FIG. 2, the seed cotton dryer stage 15 may include a gas supply 29, such a propane tank or a natural gas supply line, etc., a burner 31 coupled to the gas supply 29 by pipes 33 or the like, and a hot air stream 35 or the like created by the fan 28 and heated by the burner 31 for simultaneously conveying the seed cotton 13 from the seed cotton feeder 27, and removing moisture from the seed cotton 13 as it is so conveyed. Thus, as illustrated in FIG. 3, the hot air stream 35 flows to the seed cotton feeder 27 where it is mixed with the seed cotton 13 to form a combined seed cotton 13/hot air stream 35 from the seed cotton feeder 27 to the slide 40 or other parts of a gin stand 17, etc. The dryer control means 23 of the apparatus 11 preferably includes a gas control valve 36 for controlling the flow of gas from the gas supply 29 to the burner 31 through the pipes 33, a gas flow meter 37 for measuring the flow of gas from the gas supply 29 to the gas control valve 36 to provide accurate data as a process variable in a PID control algorithm loop controlling the gas control valve 36, and a heater ignition and safety control 38. The gas control valve 36 preferably consists of a proportional electrical actuator controlled V port ball valve or the like. The gas flow meter 37 may be a typical gas flow turbine meter well known to those skilled in the art. For example, the gas flow meter 37 may consist of a Sponsler Turbine Meter, Part # ZZ-SPICBPH12 with a Sponsler Loop Powered 4-20ma transmitter, Part # L ZZ-SP712, both manufactured by Sponsler, Inc., a unit of IDEX Corporation, 2363 Sandifer Blvd., Westminster, S.C. 29693. It should be noted that the cotton gin may include two or more substantially identical seed cotton dryer stages 15 (see FIG. 3) arranged in parallel to or in series with one another, etc., using hot air or the like to remove moisture from the seed cotton 13.

Measuring the rate of seed cotton 13 entering the seed cotton dryer stage 15 is a critical feature of the present invention. The word "rate" is defined by *Webster's Third New International Dictionary*, copyright 1976, by G. & C. Merriam Co., as "quantity, amount, or degree of something measured per unit of something else." When used herein in reference to seed cotton 13 entering the seed cotton dryer stage 15, the word "rate" refers to a quantity or volume of seed cotton per unit of time, eg., pounds or bales of seed cotton per second or minute, etc. The rate measuring means 19 of the present invention preferably measures the "rate" of seed cotton 13 entering the seed cotton dryer stage 15 of the cotton gin in pounds of seed cotton per second. Likewise, when used herein in reference to measuring the rate of seed cotton 13 entering the seed cotton dryer stage 15 and measuring the moisture content of the seed cotton 13 entering the seed cotton dryer stage 15, the word "entering" is not used to limit or define the physical location of measuring the rate and/or moisture level, but only to mean that wherever the actual measurement is physically taken (e.g., at the seed cotton feeder 27, in an air stream or conveyor between the seed cotton feeder 27 and the seed cotton dryer stage 15, at the entrance or exit of the seed cotton dryer stage 15, within the seed cotton dryer stage 15, etc.), the actual rate of seed cotton 13 and/or moisture content of the seed cotton 13 entering the seed cotton dryer stage 15 can be accurately determined based on that measurement.

The rate measured by the rate measuring means 19 can be determined by several different mechanisms depending upon which is the most practical for the specific individual ginning system. The actual construction of the rate measuring means 19 may be substantially similar to the rate measuring means "21" disclosed in the cotton moisture restoration apparatus and method of Lewis et al., U.S. Pat. No. 6,389,647, issued May 21, 2002, for measuring the rate of lint cotton exiting the battery condenser of a cotton gin. See, for example, column 3, line 61, through column 4, line 23, of Lewis et al., U.S. Pat. No. 6,389,647. Thus, for example, the rate measuring means 19 may include dual potentiometers to replace a typical speed potentiometer on the seed cotton feeder 27. That is, one of the dual potentiometers will provide seed cotton feed roller speed input signal, and the other of the dual potentiometers, in conjunction with a 10 volt D.C. power supply or the like, will give an analog input (i.e., signal 41 as shown in FIG. 1) to the PLC 25 which can be scaled by the PLC 25 to determine the rate of seed cotton 13 entering the seed cotton dryer stage 15. On the other hand, the rate measuring means 19 could include a DC/DC transducer connected directly to a speed potentiometer of a feed roller controller of the seed cotton feeder 27 (the controller can be DC or AC invertor), with the output of the transducer (i.e., signal 41 as shown in FIG. 1) connected to the analog input on the PLC 25 so the PLC 25 can scale the analog input to determine the rate of seed cotton 13 entering the seed cotton dryer stage 15 to send the appropriate signal 41 to the PLC 25 via the line 42 (see FIG. 3). Alternatively, the rate measuring means 19 could include a DC sensor (e.g., an inductive proximity switch such as a Censtable AM series M12DC inductive proximity switch, Model AM1-AN14A) used to count the teeth on a feeder roller shaft of the seed cotton feeder 27. By sending a DC pulse (i.e., signal 41 as shown in FIG. 1) to the PLC 25 as each tooth passes by the sensor, the rate of seed cotton 13 entering the seed cotton dryer stage 15 can be determined by the PLC 25. The specific rate measuring means 19 used in a specific gin can be based on many factors, including the structure and operation of the gin itself, the desires of gin management, etc.

The moisture content measured by the moisture content measuring means 21 can be determined by several different mechanisms depending upon which is the most practical for the specific individual ginning system. The actual construction of the moisture content measuring means 21 may be substantially similar to the moisture content measuring means "25" disclosed in the cotton moisture restoration apparatus and method of Lewis et al., U.S. Pat. No. 6,389,647, issued May 21, 2002, for measuring the rate of lint cotton exiting the battery condenser of a cotton gin. See, for example, column 3, lines 45–55, of Lewis et al., U.S. Pat. No. 6,389,647. Thus, for example, the moisture content measuring means 21 preferably consists of a Moisture Register Products BSP 901-1 Mod-115 Moisture Measuring System radio frequency sensor marketed by Moisture Register Products, a division of Aqua Measure Instrument Co., 1712 Earhart Court, La Verne, Calif. 91750-0369. Such a moisture content measuring means 21 may have a sensor located within the seed cotton feeder 27 as shown diagrammatically in FIG. 3, and electrically coupled to the PLC 25 via a line 43 (see FIG. 3), for sending a signal 45 to the PLC 25 (see FIG. 1) which can be scaled by the PLC 25 to determine the moisture content of the seed cotton 13 entering the seed cotton dryer stage 15.

The apparatus 11 may include an ambient temperature sensor 47 for measuring the ambient or room temperature within the cotton gin. The ambient temperature sensor 47 may be of various types known to those skilled in the art. Thus, for example, the ambient temperature sensor 47 may consist of a Pyromation Type J thermocouple, part # J39G-006-00-6HN31, marketed by Pyromation, Inc., 5211 Industrial Road, Fort Wayne, Ind. 46825. Such an ambient temperature sensor 47 may have a sensor located at a centralized location within the cotton gin, and electrically coupled to the PLC 25 via a line 49 (see FIG. 3), for sending a signal 51 to the PLC 25 (see FIG. 1) which can be scaled by the PLC 25 to determine the ambient or room temperature within the cotton gin, etc.

The apparatus 11 may include desired moisture level control 53 for allowing gin management to enter the desired moisture level of the seed cotton 13 leaving the seed cotton dryer stage 15. The desired moisture level control 53 may be of various types known to those skilled in the art. Thus, for example, the desired moisture level control 53 may consist of an Automationdirect Operator Interface, Part # EZ-S8C-F, marketed by Automationdirect.com, 3505 Hutchinson Road, Cumming, Ga. 30040. Such a desired moisture level control 53 may have a control panel located at a centralized location within the cotton gin, and may be electrically coupled to the PLC 25 via a line 55 (see FIG. 3), for sending a signal 57 to the PLC 25 (see FIG. 1) which can be scaled by the PLC 25 to determine the desired moisture level of the seed cotton 13 leaving the seed cotton dryer stage 15.

Figure 4:
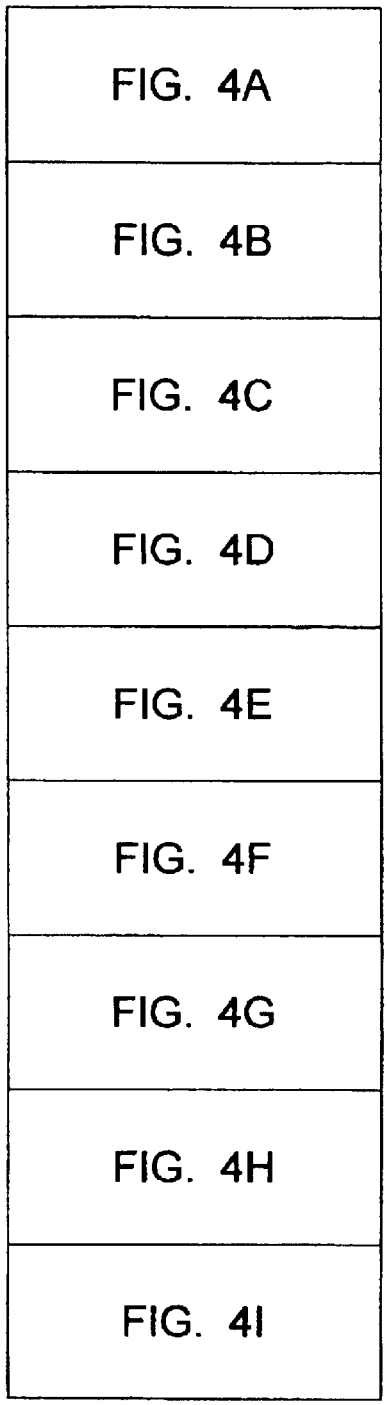
FIG. 4 is a diagram showing the arrangement of FIGS. 4A–4I.
Figure 4A:
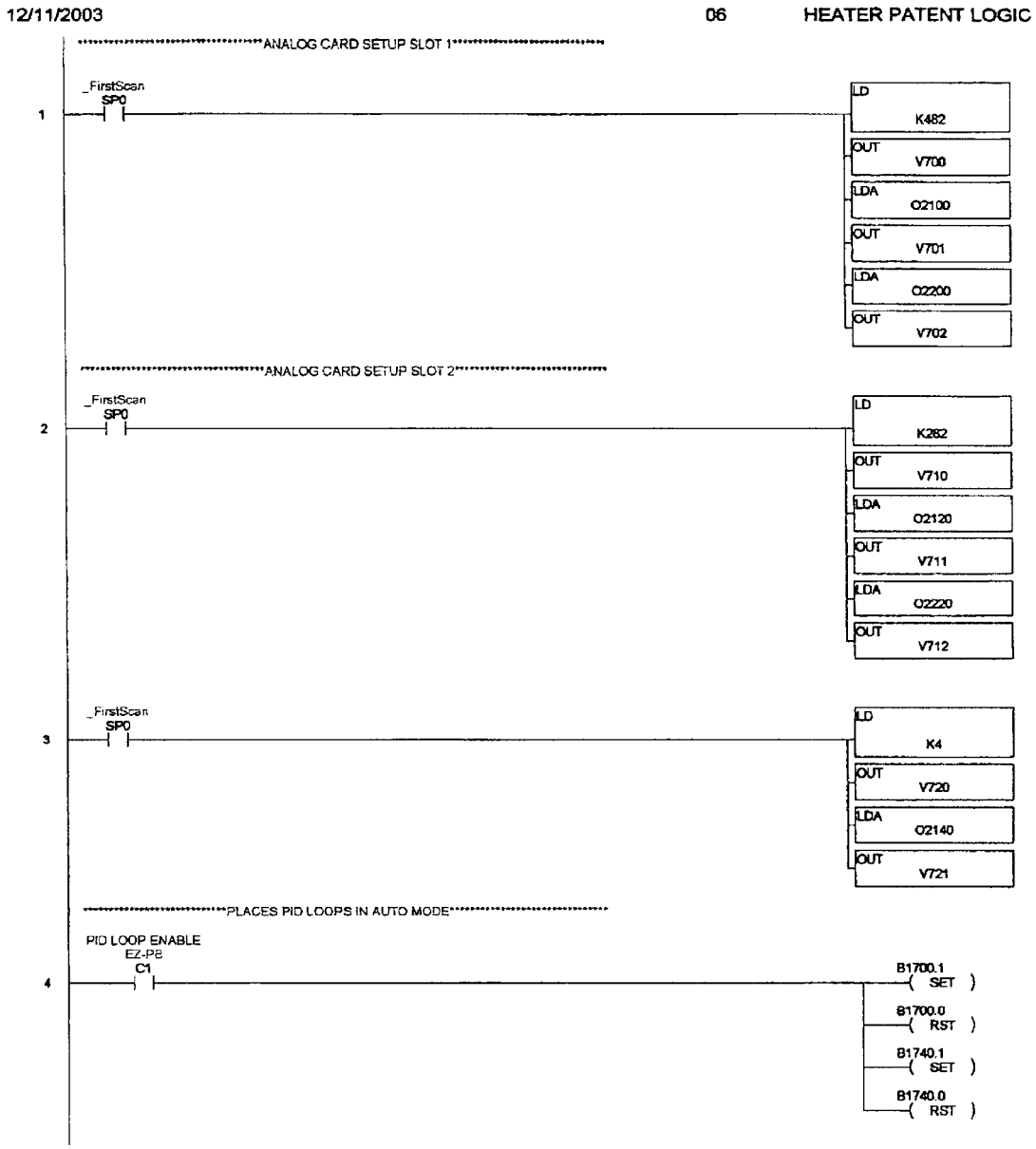
Figure 4B:
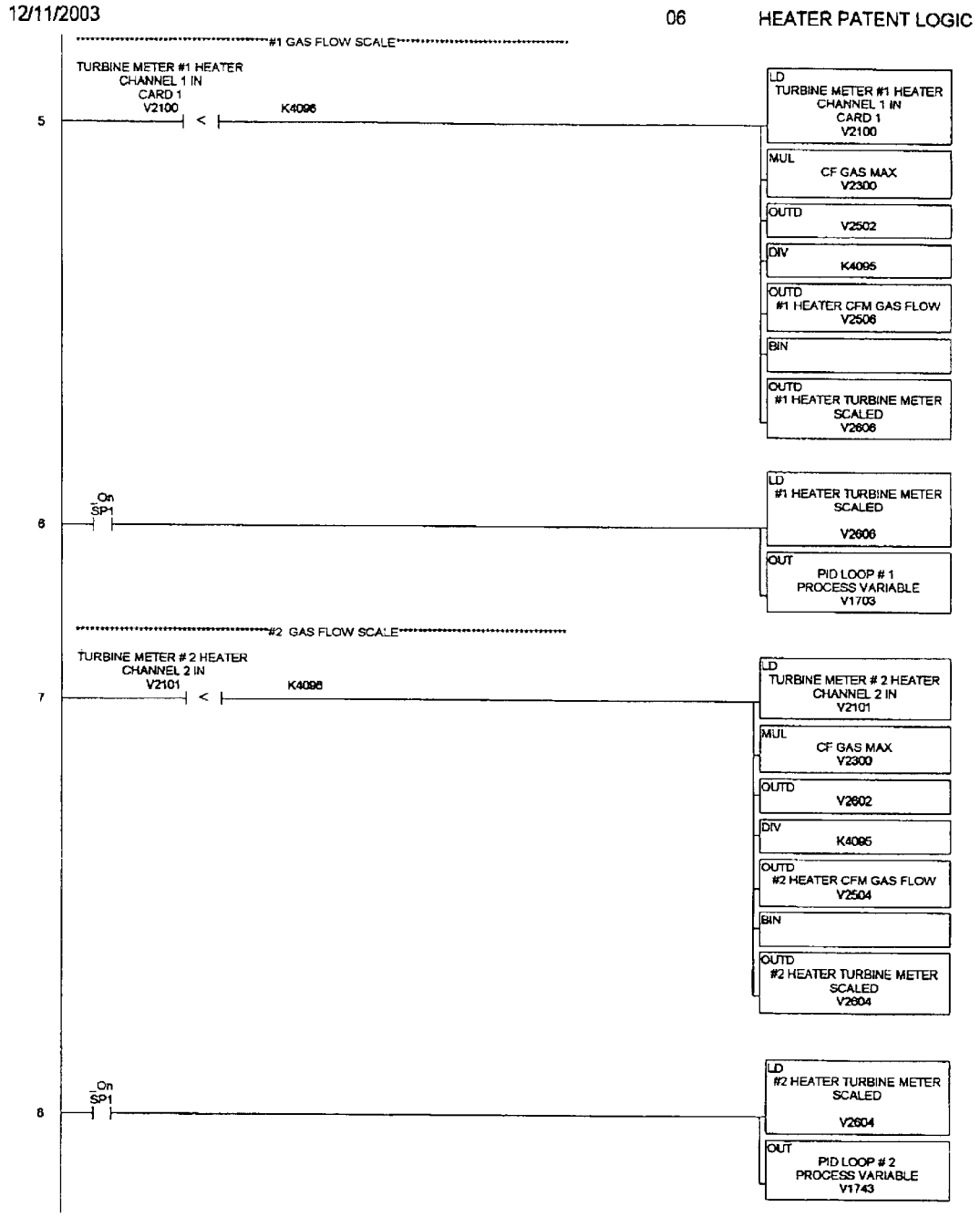
Figure 4C:
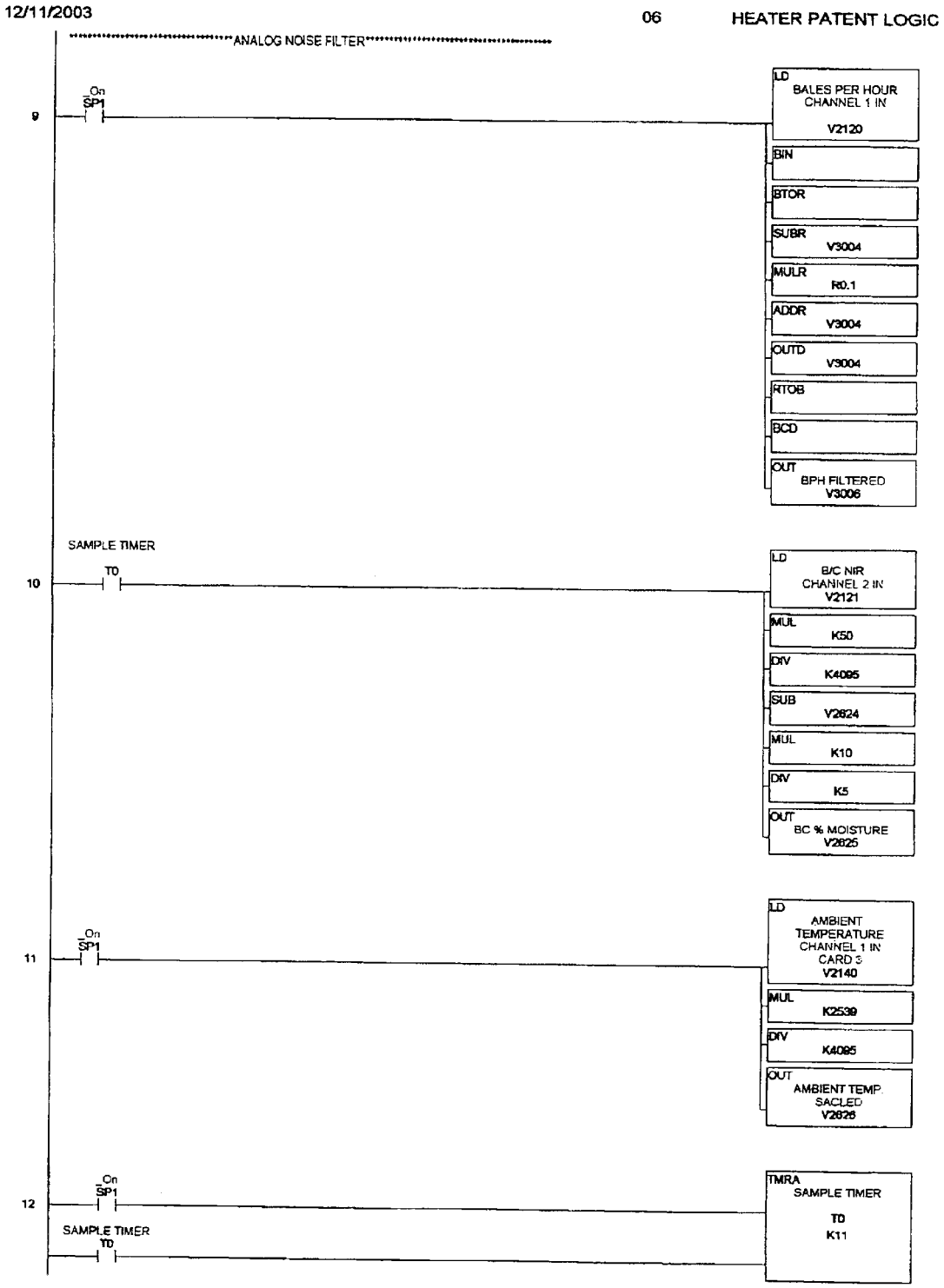
Figure 4D:
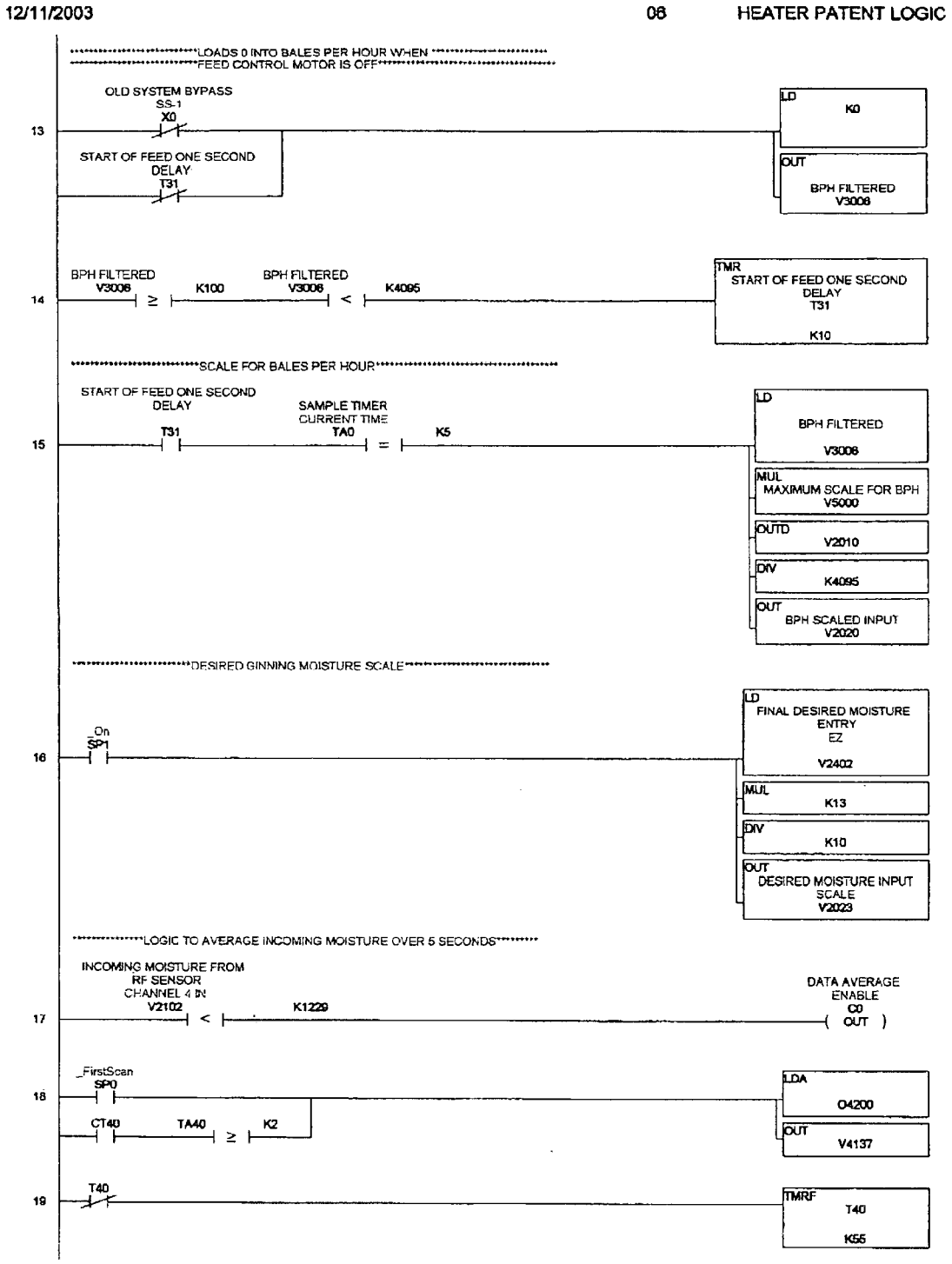
Figure 4E:
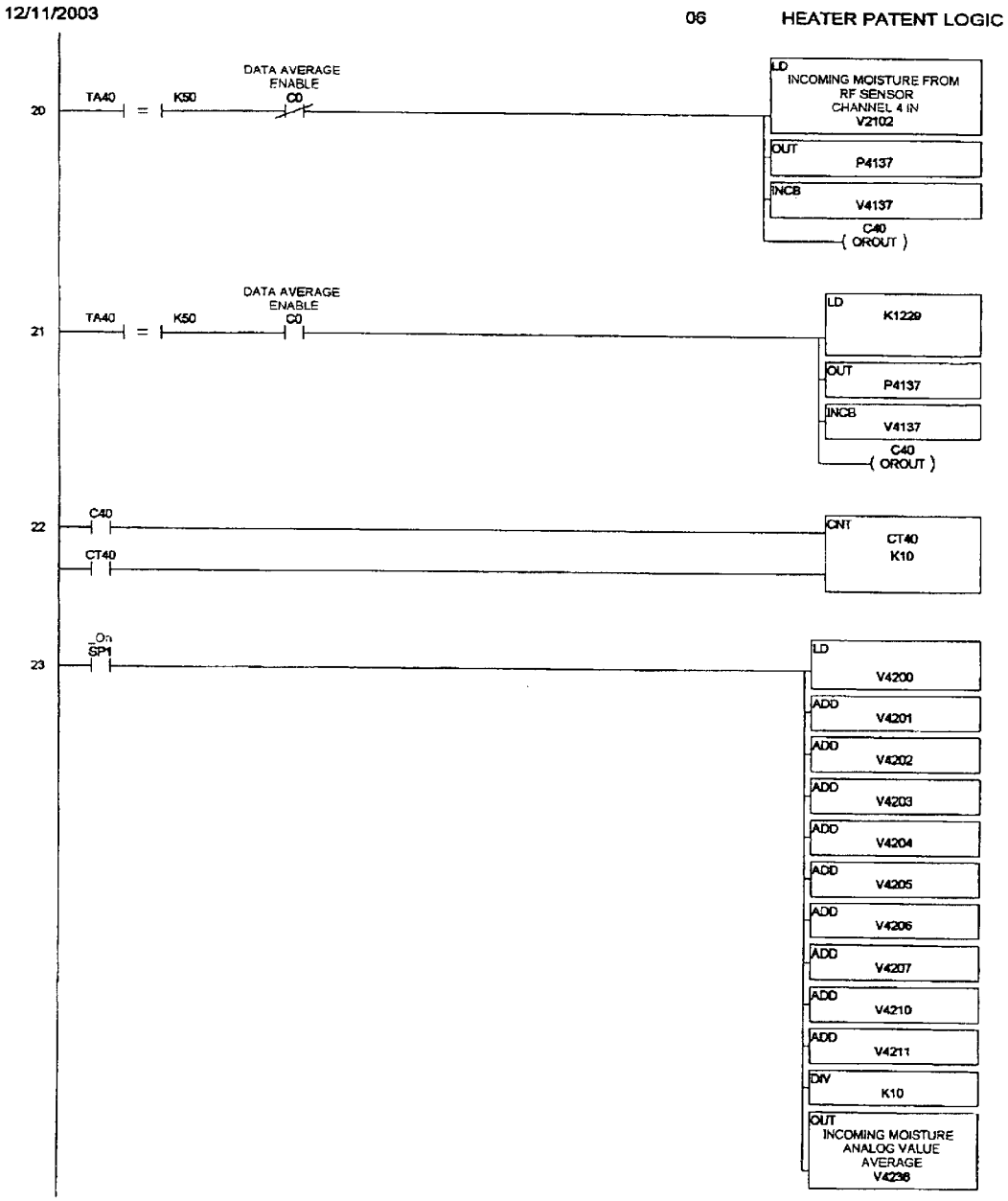
Figure 4F:
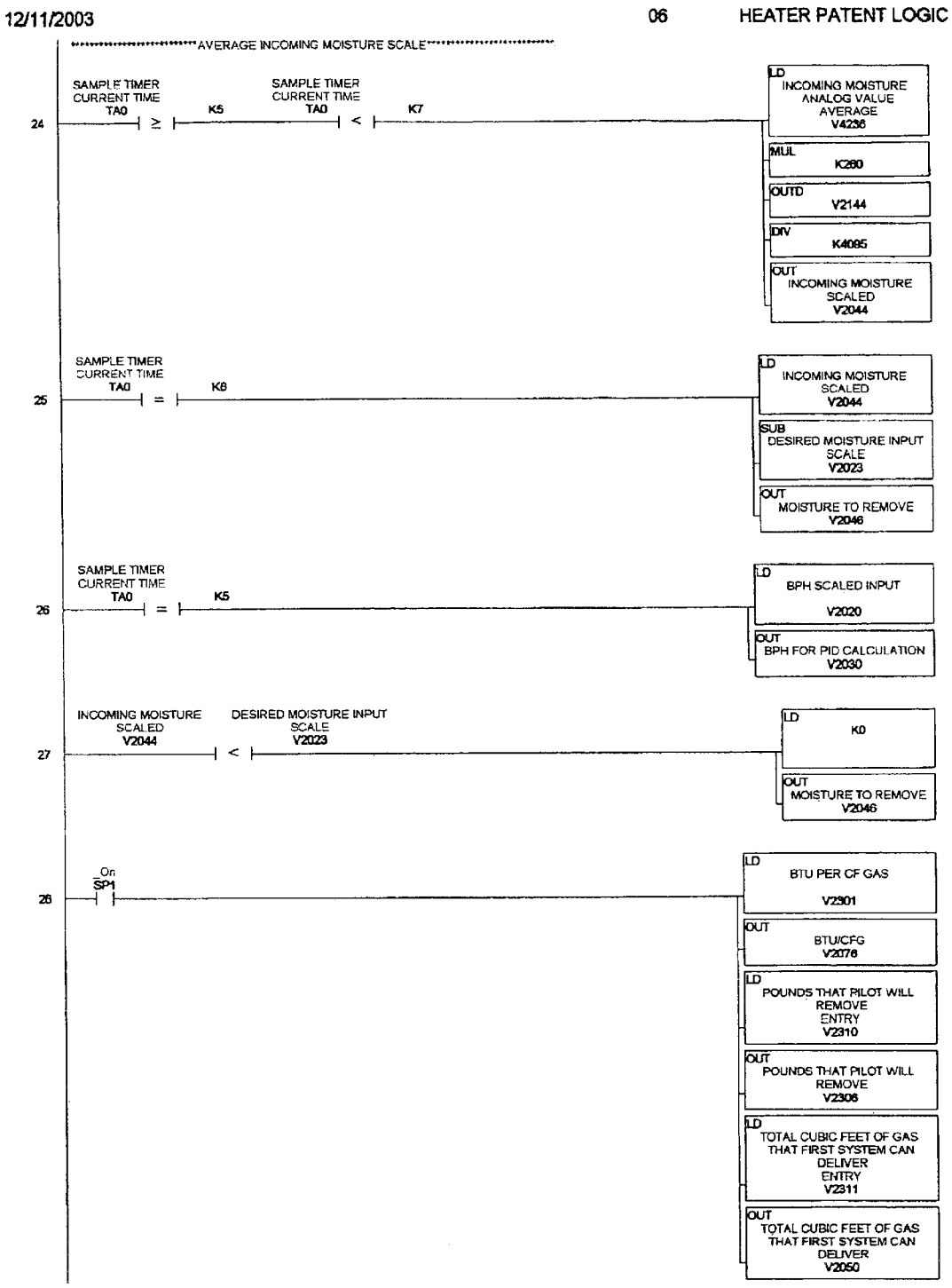
Figure 4G:
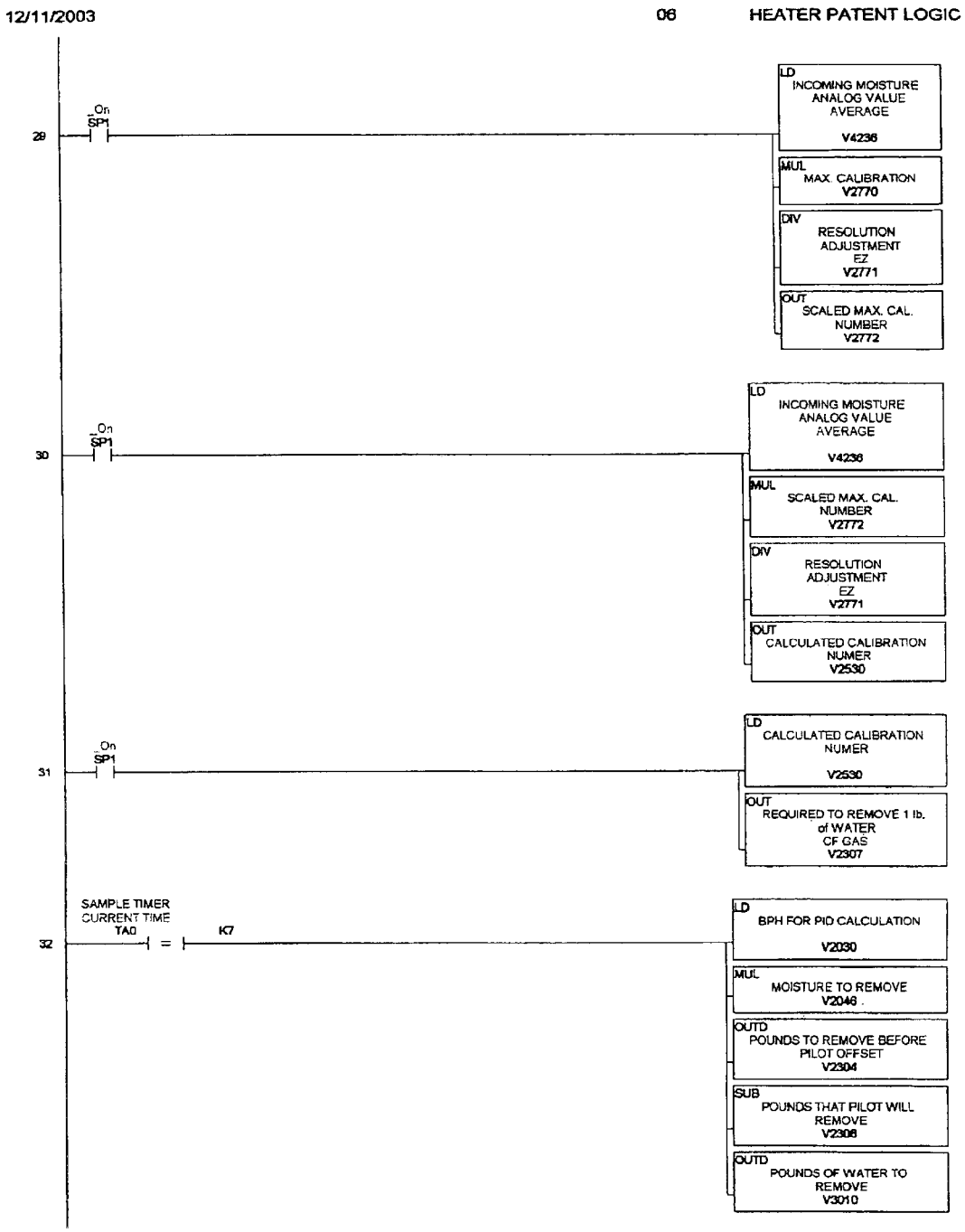
Figure 4H:
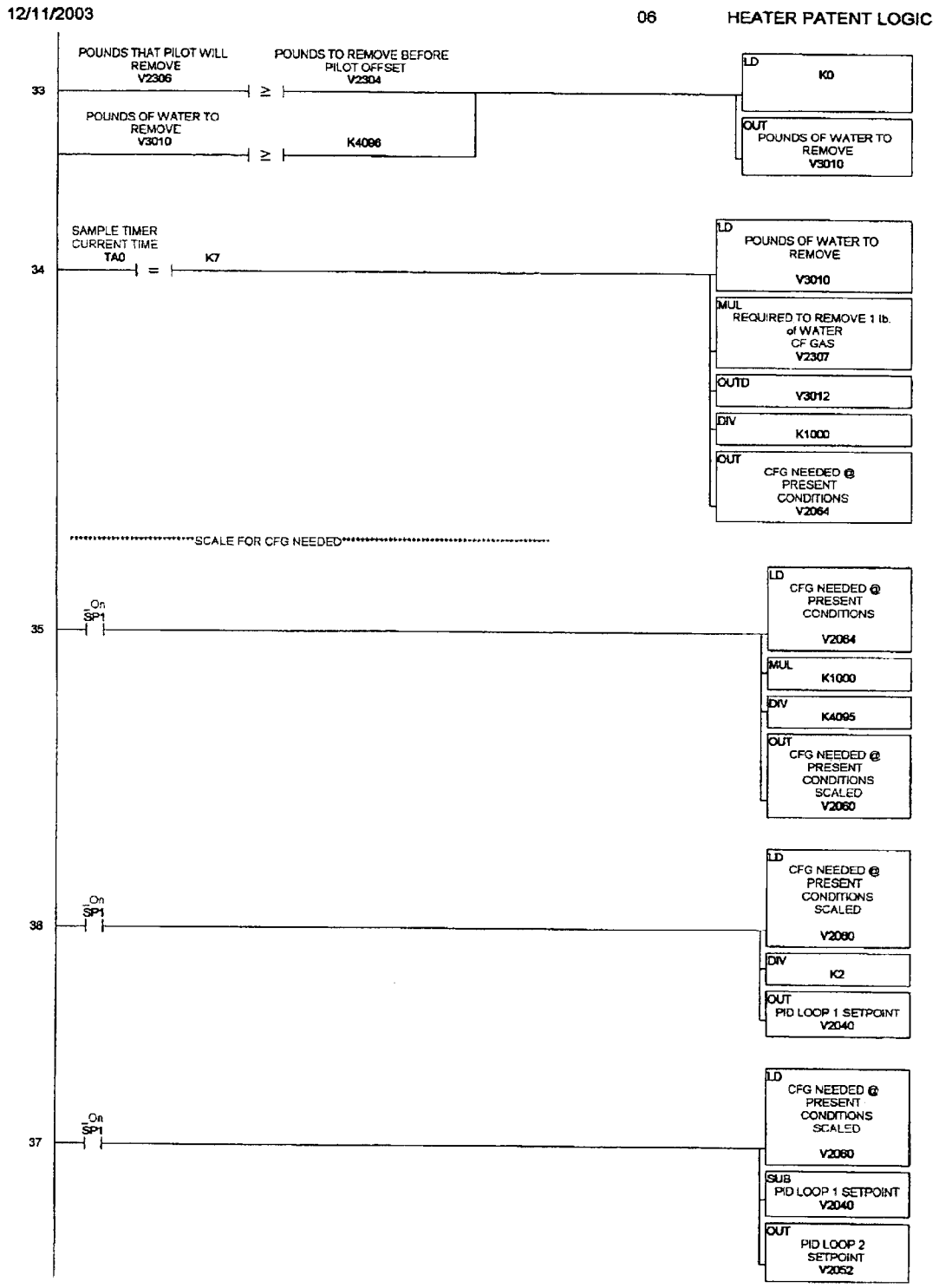
Figure 41:
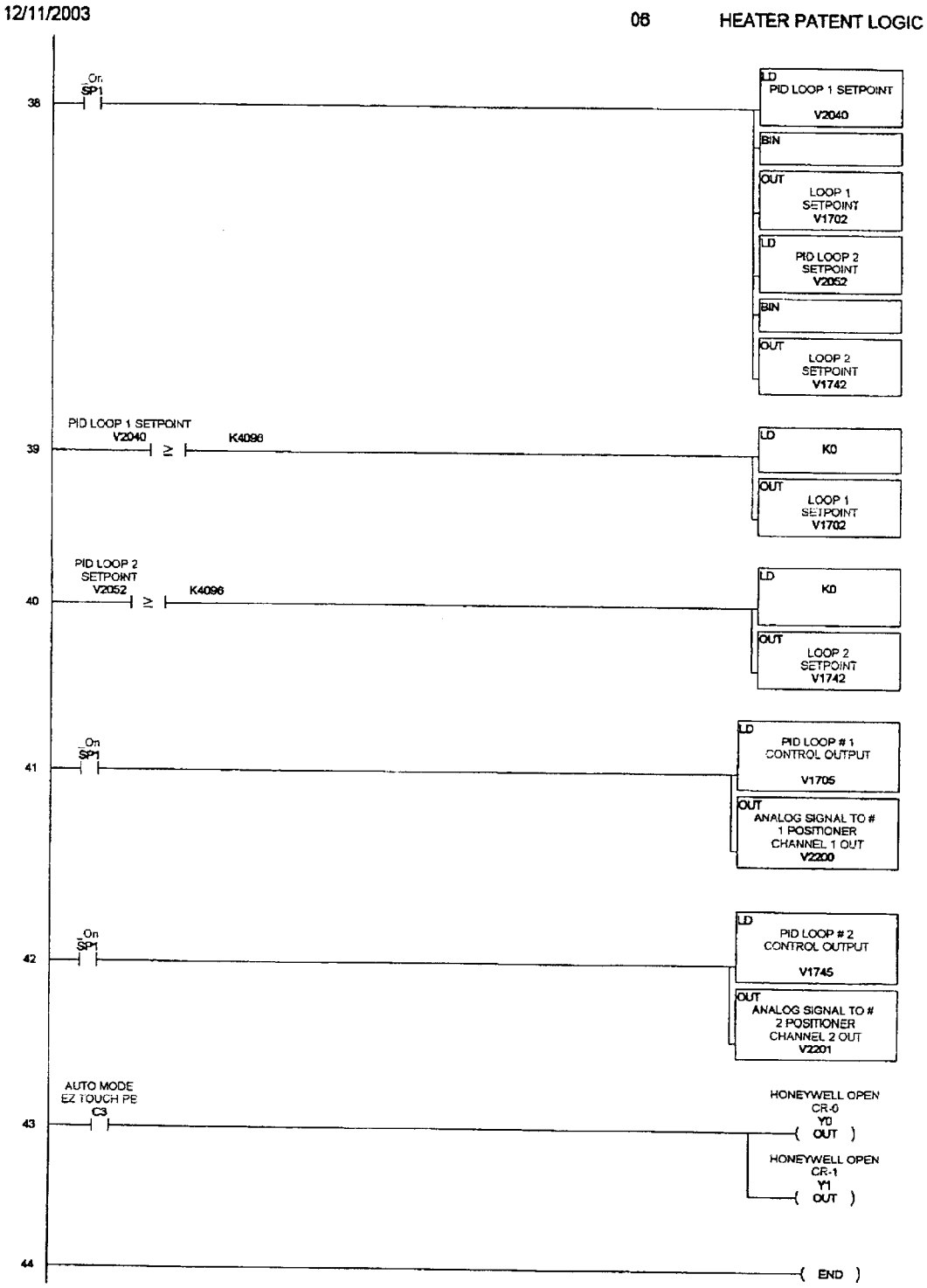

The PLC 25 is preferably controlled by the program disclosed in FIGS. 4A–4I, taken together and arranged as shown in FIG. 4, using a signal 41 from the rate measuring means 19 (e.g., analog outputs from potentiometers, transducers or sensors as hereinabove disclosed relative to the several possible embodiments of the rate measuring means 19) as inputs to ginning rates V2120 in the program to calculate the rate of seed cotton 13 entering the seed cotton dryer stage 15. An analog output or signal 45 from the moisture content measuring means 21 as determined from the seed cotton 13 entering the seed cotton dryer stage 15 is used in the program as incoming moisture sensor V2102. An analog output or signal 51 from the ambient temperature sensor 47 is used in the program as ambient temperature sensor V2140. An analog output or signal 57 from the desired moisture level control 53 is used in the program as desired moisture level V2402. The gas flow meter 37 calculates the flow of gas through the supply pipe 33 to the gas control valve 36, and sends the appropriate signal 59 to the PLC 25 (see FIGS. 1 and 2) via the line 61 (see FIG. 3). The program then calculates and determines when and how much gas needs to pass from the gas supply 29 to the burner 31 to dry the seed cotton 13 passing through the seed cotton dryer stage 15, and sends the appropriate signals 63 to the gas control valve 36 (see FIGS. 1 and 2) via the line 65 (see FIG. 3).

The preferred method of the present invention includes the steps of measuring the incoming moisture content of the seed cotton 13 entering the seed cotton dryer stage 15 using, for example, the moisture content measuring means 21; measuring the rate of seed cotton 13 entering the seed cotton dryer stage 15 using, for example, the rate measuring means 19; and then removing an amount of moisture from the seed cotton 13 in the seed cotton dryer stage 15 based on the desired moisture content of the seed cotton 13 leaving the seed cotton dryer stage 15, the moisture content of the seed cotton 13 entering the seed cotton dryer stage 15, and the rate of seed cotton 13 entering the seed cotton dryer stage 15. The gas flow rate needed to remove that desired amount of moisture, depending on the efficiency of the specific seed cotton dryer stage 15, the rate and moisture content of the seed cotton 13 entering the seed cotton dryer stage 15, etc., is computed by the PLC 25. The actual gal flow rate is measured by the gas flow meter 37, and the gas control valve 36 is then adjusted based on that data.

As thus constructed and used, the present invention can automatically remove a desired amount moisture from the seed cotton 13 passing through the seed cotton dryer stage 15, to deliver a very accurate moisture regardless of the incoming moisture or the rate of the seed cotton.

Although the present invention has been described and illustrated with respect to a preferred embodiment and a preferred use therefor, it is not to be so limited since modification and changes can be made therein which are within the full intended scope of the invention.

What is claimed is:

1. An apparatus for controlling the removal of moisture from seed cotton in a cotton gin including a seed cotton dryer stage, the seed cotton leaving the seed cotton dryer stage having a desired moisture content; said apparatus comprising:

(a) rate measuring means for measuring the rate of seed cotton entering the seed cotton dryer stage;

(b) moisture content measuring means for measuring the moisture content of the seed cotton entering the seed cotton dryer stage; and (c) seed cotton dryer stage control means for causing the seed cotton dryer stage to remove an amount of moisture from the seed cotton based on the desired moisture content of the seed cotton leaving the seed cotton dryer stage, the moisture content of the seed cotton entering the seed cotton dryer stage, and the rate of seed cotton entering the seed cotton dryer stage.

2. The apparatus of claim 1 which said moisture content measuring means includes a radio frequency sensor.

3. The apparatus of claim 1 in which said seed cotton dryer stage is gas operated; in which said seed cotton dryer stage control means includes a gas control valve for controlling the flow of gas to said gas operated seed cotton dryer stage and a gas flow meter for measuring the flow of gas to said gas control valve.

4. A method for controlling the removal of moisture from seed cotton in a cotton gin, the cotton gin including a seed cotton dryer stage, the seed cotton having a desired moisture level; said method comprising:

(a) measuring the rate of seed cotton entering the seed cotton dryer stage;

(b) measuring the moisture content of the seed cotton entering the seed cotton dryer stage; and (c) controlling the seed cotton dryer stage to remove an amount of moisture from the seed cotton in the seed cotton dryer stage based on the desired moisture content of the seed cotton leaving the seed cotton dryer stage, the moisture content of the seed cotton entering the seed cotton dryer stage, and the rate of seed cotton entering the seed cotton dryer stage.

5. A method for removing moisture from seed cotton in a cotton gin; the seed cotton having a desired moisture content; the cotton gin including a seed cotton feeder, a gas operated seed cotton dryer stage; said method comprising:

(a) measuring the moisture content of the seed cotton entering the seed cotton dryer stage;

(b) measuring the rate of seed cotton entering the seed cotton dryer stage; and (c) controlling the amount of gas fed to the seed cotton dryer stage to remove an amount of moisture from the seed cotton based on the desired moisture content of the seed cotton, the moisture content of the seed cotton entering the seed cotton dryer stage, and the rate of seed cotton entering the seed cotton dryer stage.

6. The method of claim 5 in which said step of controlling the amount of gas fed to the seed cotton dryer stage includes the step of measuring the flow of gas to the seed cotton dryer stage.

* * * * *